US010199784B2

(12) United States Patent
SooHoo et al.

(10) Patent No.: US 10,199,784 B2
(45) Date of Patent: Feb. 5, 2019

(54) ELECTRONIC CONNECTOR

(71) Applicant: Apple Inc., Cupertino, CA (US)

(72) Inventors: Eric T. SooHoo, Sunnyvale, CA (US); Robert A. Boyd, Los Angeles, CA (US); Daniel C. Wagman, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 121 days.

(21) Appl. No.: 15/686,077

(22) Filed: Aug. 24, 2017

(65) Prior Publication Data

US 2018/0069361 A1 Mar. 8, 2018

(51) Int. Cl.

| | |
|---|---|
| ***H01R 31/00*** | (2006.01) |
| ***H01R 27/00*** | (2006.01) |
| ***H01R 29/00*** | (2006.01) |
| ***H01R 12/70*** | (2011.01) |
| ***H01R 24/20*** | (2011.01) |
| ***H01R 24/62*** | (2011.01) |
| ***H01R 13/405*** | (2006.01) |
| ***H01R 13/66*** | (2006.01) |
| *H01R 107/00* | (2006.01) |

(52) U.S. Cl.

CPC ..... *H01R 29/00* (2013.01); *H01R 12/7076* (2013.01); *H01R 13/405* (2013.01); *H01R 13/6658* (2013.01); *H01R 24/20* (2013.01); *H01R 24/62* (2013.01); *H01R 2107/00* (2013.01)

(58) Field of Classification Search

CPC ..... H01R 31/06; H01R 27/00; H01R 31/02; H01R 23/7073; H01R 23/02

USPC ..... 439/502, 660, 218

See application file for complete search history.

(56) References Cited

U.S. PATENT DOCUMENTS

| | | | | |
|---|---|---|---|---|
| 5,540,601 | A * | 7/1996 | Botchek | H01R 31/06 439/217 |
| 8,784,123 | B1 * | 7/2014 | Leiba | H01R 27/00 439/218 |
| 8,911,262 | B1 * | 12/2014 | Leiba | H01R 24/60 439/660 |
| 9,515,442 | B2 * | 12/2016 | Cymerman | H01R 31/06 |
| 2002/0001999 | A1 * | 1/2002 | Vaden | H01R 4/2404 439/502 |
| 2002/0002004 | A1 * | 1/2002 | Akama | H01R 12/62 439/625 |
| 2013/0244492 | A1 * | 9/2013 | Golko | H01R 13/516 439/660 |

(Continued)

*Primary Examiner* — Gary Paumen

(74) *Attorney, Agent, or Firm* — Kilpatrick Townsend & Stockton

(57) ABSTRACT

A unidirectional cable connector that can be operatively connected between a host device and accessory device in the ecosystem of products. The cable includes first and second plug connectors at opposite ends of a wire where the two plug connectors share a common pinout but the insertion plug of the second connector is shortened in length as compared to the insertion plug of the first connector. The shortened plug prevents the second connector from being fully inserted into the host device that includes a standard depth receptacle connector, and thus prevents the second connector from being operatively coupled to the host device. The shortened plug can, however, be operatively connected with an electronic device having a shortened receptacle connector according to embodiments of the disclosure.

20 Claims, 8 Drawing Sheets

(56) References Cited

U.S. PATENT DOCUMENTS

| | | | | |
|---|---|---|---|---|
| 2015/0180147 | A1* | 6/2015 | Sun | G06K 7/0021<br>439/218 |
| 2015/0280383 | A1* | 10/2015 | Liu | H01R 29/00<br>439/218 |
| 2016/0118758 | A1* | 4/2016 | Cymerman | H01R 31/06<br>439/39 |
| 2017/0373450 | A1* | 12/2017 | Solland | H01R 29/00 |

* cited by examiner

ELECTRONIC CONNECTOR

CROSS-REFERENCES TO RELATED APPLICATIONS

This application claims priority to U.S. Provisional Patent Application No. 62/384,049, filed Sep. 6, 2016, the disclosure of which is hereby incorporated by reference in its entirety.

FIELD

The present disclosure relates generally to electronic connectors, such as connectors that can be used to transfer data and/or power from one electronic device to another.

BACKGROUND

Many portable electronic devices include an electrical connector that enables the device to be operatively connected to another electronic device to transfer data between the devices and/or provide power to and change a battery within the portable electronic device. Such connectors are designed to particular standards and requirements regarding the size, shape, contact configuration and other criteria that are required for two corresponding connectors to mate with each other. Typically, such connector pairs include a female receptacle connector and a male plug connector that is inserted into the receptacle connector during the mating event. The plug connector and receptacle connector pairing can be part of an ecosystem of products that includes both host electronic devices and accessory devices designed to work together. For example, host electronic devices in the ecosystem that include a receptacle connector can be connected to accessory electronic devices from the eco system that includes the corresponding plug connector.

SUMMARY

In an ecosystem of electronic products, it can sometimes be beneficial for an accessory device to include the same gender connector (e.g., receptacle connector) as the host device. As one example, a host device and an accessory device might both include the same type of receptacle connector (i.e., receptacle connectors that are mechanically and electrically compatible with the same plug connector) that enables each device to be charged by the same charging cable. That is, the plug connector of the charging cable can be inserted within and operatively mated with the receptacle connector of either the host device or the accessory device to provide power to the mated device.

To minimize the number of connectors included within an accessory device, it can also be beneficial if the accessory device can be connected to the host device by a cable that electrically connects the receptacle connector on the host to the receptacle connector on the accessory instead of requiring such a cable to be mated with a second, different connector on the accessory device. As one particular example, it can be beneficial for both a smart phone and a pair of headphones in a particular ecosystem of products to include a receptacle connector that allows a single charging cable to provide power to either the smart phone or the headphones. It can also be beneficial for the ecosystem to include a cable that enables the headphones to be directly connected to the smart phone via the receptacle connectors in each device so that audio signals from the smart phone can be output to and played on the headphones. For example, even if the headphones are wireless headphones, there may be environments in which a wireless connection is undesirable or even prohibited, such as on airplanes. A cable that connects between receptacle connectors of such electronic devices can include two plug connectors at opposing ends of the cable, one of which would be inserted into the smart phone receptacle connector and one of which would be inserted into the headphone receptacle connector. The presence of such a cable in the ecosystem could give rise to an impression that the cable could also be used to transfer data, power or other useful signals from one host device to another host device (e.g., between two smart phones or between a smart phone and a tablet computer) even though the host devices in the ecosystem might not support such functionality. Thus, if not properly designed, such a cable in such an ecosystem could lead to user frustration.

Some embodiments of the disclosure pertain to a receptacle connector that can be included in an accessory device that has essentially the same shape and pinout as the standard receptacle connector of the host device in a given ecosystem of products but that has an insertion cavity that is shorter than the standard receptacle connector. Some embodiments of the disclosure also pertain to a unidirectional cable that can be operatively connected between a host device and accessory device in the ecosystem of products. The cable includes first and second plug connectors at opposite ends of a wire where the insertion plug of the second connector is shortened in length as compared to the insertion plug of the first connector. The shortened plug prevents the second connector from being fully inserted into the host device that includes a standard depth receptacle connector, and thus prevents the second connector from being operatively coupled to the host device. The shortened plug can, however, be operatively connected with an electronic device having a shortened receptacle connector according to embodiments of the disclosure.

In this manner, a connector cable according some embodiments of the disclosure can be used to transfer data (e.g., audio data) between a host device having a standard depth receptacle connector and an accessory device having a shortened receptacle connector as long as the cable is connected such that the shortened plug connector is mated with the shortened receptacle connector and the standard plug connector is mated with the standard receptacle connector. The cable cannot, however, be used to electrically connect two devices that each have standard depth receptacle connectors (e.g., two host devices) as the shortened plug connector cannot be operatively connected to the receptacle connector of either such device.

In some embodiments, the receptacle connectors on the host and accessory devices can include retention mechanisms that latch with retention mechanisms on a plug connector. In such embodiments, the length of the second plug connector of the cable can be sufficiently short that the second plug connector does not engage with the retention mechanism of the standard host receptacle connector during a mating event and thus provides a user no mechanical feedback and will simply fall out of the receptacle if moved. The first plug connector, on the other hand, can be operatively connected to, and provide mechanical feedback when mated with, either the shortened receptacle connector or the standard receptacle connector.

In some embodiments an electrical cable connector is provided. The cable connector can include a cable having a first end and a second end; a first plug connector at the first end of the cable, the first plug connector including a first body, a first insertion end extending away from the first body to a first connector tip and a first plurality of contacts, the first insertion end and the first plurality of contacts sized and positioned to be mated with and mechanically and electrically compatible with a first receptacle connector; and a second plug connector at the second end of the cable, the second plug connector including a second body, a second insertion end extending away from the second body to a second connector tip and a second plurality of contacts, the second insertion end and second plurality of contacts configured to be mated with and mechanically and electrically compatible with the first receptacle connector. The first insertion end can have a first length from the first connector tip to the first body and the second insertion end can have a second length from the second connector tip to the second body, the second length being shorter than the first length such that the first insertion end and first plurality of contacts are configured to be mated with and mechanically and electrically compatible with a second receptacle connector having an insertion cavity that is deeper than an insertion cavity of the first receptacle connector while the second insertion end and second plurality of contacts are mechanically incompatible with the second receptacle connector.

In some embodiments, a cable connector according to the disclosure includes a cable having a first end and a second end; a first plug connector at the first end of the cable, the first plug connector including a first body, a first insertion end extending away from the first body to a first connector tip, and a first plurality of contact; and a second plug connector at the second end of the cable, the second plug connector including a second body, a second insertion end extending away from the second body to a second connector tip, a second plurality of contacts, wherein the second insertion end and the second plurality of contacts are sized and positioned to be mated with and mechanically and electrically compatible with the first receptacle connector. The first plug connector can be operatively coupled with a first receptacle connector having a first plurality of receptacle connector contacts positioned within a first cavity at a first distance from an opening of the first cavity and the second plug connector can be operatively coupled with the first receptacle connector. The first plug connector can also be operatively coupled with a second receptacle connector having a second plurality of receptacle connector contacts positioned within a second cavity at a second distance from an opening of the second cavity, the second distance being less than the first distance, but the second plug connector cannot be operatively coupled with the second receptacle connector.

According to some embodiments of the disclosure a cable connector includes a cable having a first end and a second end; a first plug connector at the first end of the cable, where the first plug connector includes a first tip and a first retention mechanism configured to mate with a first receptacle connector; and a second plug connector at the second end of the cable, where the second plug connector includes a second tip and a second retention mechanism configured to mate with a second receptacle connector. A first distance can be defined between the first tip and the first retention mechanism, a second distance can be defined between the first retention mechanism and the cable, a third distance can be defined between the second tip and the second retention mechanism, and a fourth distance can be defined between the second retention mechanism and the cable such that the first distance is equal to the third distance and the second distance is greater than the fourth distance.

In various embodiments, the first and/or second plug connectors can be reversible connectors that can be inserted in the first receptacle connector in either a first orientation or a second orientation rotated 180 degrees from the first orientation, the first plurality of contacts can be exposed at an external surface of the first plug connector and the second plurality of contacts can be exposed at an external surface of the second plug connector, and each of the first and second pluralities of contacts can conform to the same pinout having the same contact spacing.

To better understand the nature and advantages of embodiments of the present disclosure, reference should be made to the following description and the accompanying figures. It is to be understood, however, that each of the figures is provided for the purpose of illustration only and is not intended as a definition of the limits of the scope of embodiments of the present disclosure. Also, as a general rule, and unless it is evident to the contrary from the description, where elements in different figures use identical reference numbers, the elements are generally either identical or at least similar in function or purpose.

DETAILED DESCRIPTION

Embodiments of the present disclosure will now be described in detail with reference to certain embodiments thereof as illustrated in the accompanying drawings. In the following description, numerous specific details are set forth in order to provide a thorough understanding of embodiments of the present disclosure. It will be apparent, however, to one skilled in the art, that embodiments of the present disclosure may be practiced without some or all of these specific details. In other instances, well known details have not been described in detail in order not to unnecessarily obscure embodiments of the present disclosure.

As used herein, a first connector can be "operatively connected to" a second connector when the connectors are both mechanically compatible and electrically compatible with each other. A plug connector can be said to be "mechanically compatible" with a receptacle connector when the plug connector is sized and shaped such that it can be physically inserted into the receptacle connector to mate with the receptacle connector, and when mated, electrical contacts of the plug connector align with and electrically contact with corresponding contacts within the receptacle connector. Thus, mechanically compatible plug connector and receptacle connectors have pinouts that are compatible with each other such that the size, position and spacing of each contact is set so that contacts of the plug connector align with contacts of the receptacle connector enabling the respective contact pairs to be electrically coupled to each other when the connectors are mated. In general, two plug connectors that are both mechanically compatible with a given receptacle connector will have plug or insertion portions that have the same cross-sectional dimensions (width and height) and same number of contacts and same contact positioning and spacing. In some instances, however, and as described in more detail below in conjunction with FIG. 10, two plug connectors can be mechanically compatible with the same receptacle connector where one of the plug connectors has a subset of the contacts that are associated with the standard or normal pinout associated with that given connector standard.

A plug connector can be said to be "electrically compatible" with a receptacle connector when, without requiring a special adapter, data signals transmitted between the plug and receptacle connector can be decoded and acted upon by the electronic devices associated with each connector and/or power transmitted between the connectors can be used to provide power to or charge an electronic device associated with one of the connectors.

Figure 1:
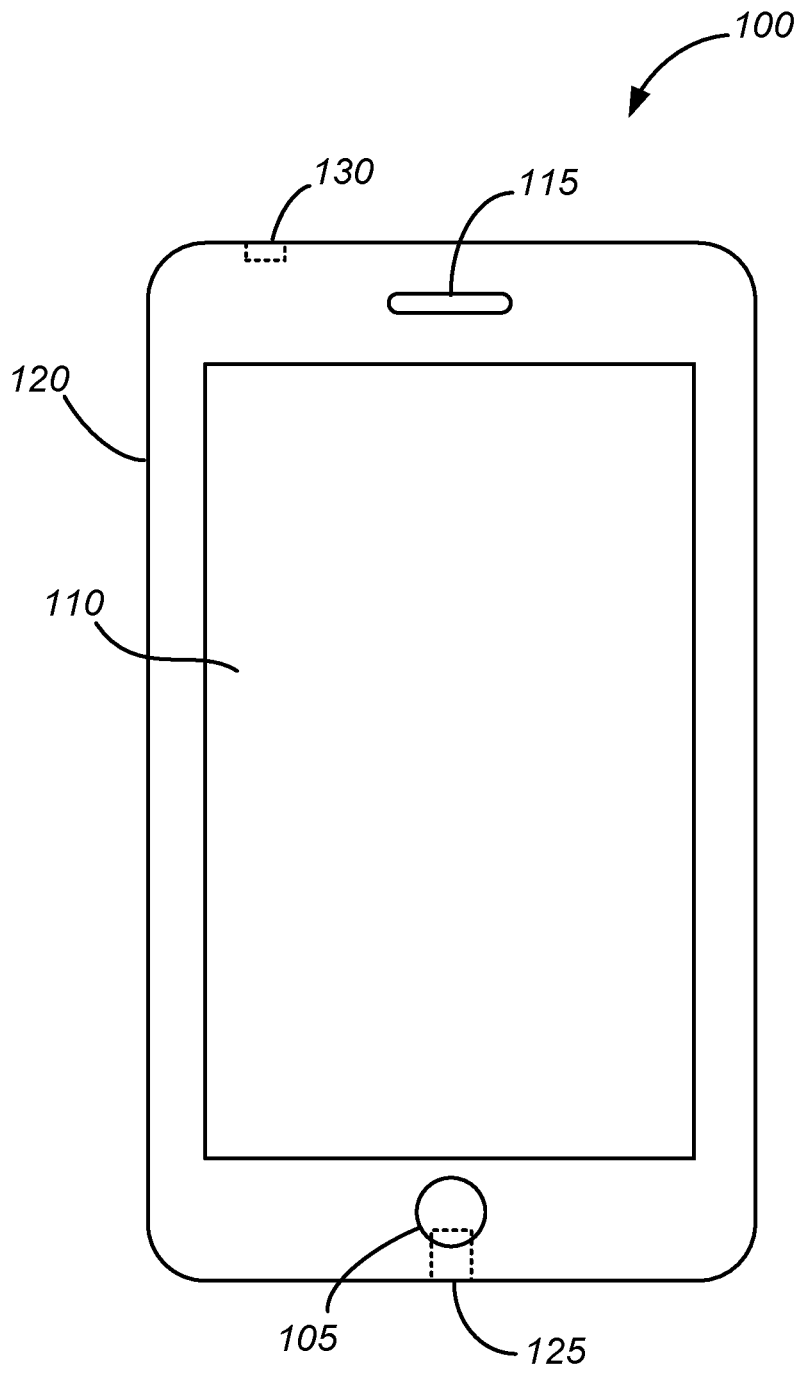
FIG. 1 shows a top view of an electronic media device in accordance with some embodiments of the disclosure.

Reference is now made to FIG. 1, which depicts a front view of one particular electronic media device 100 with which embodiments of the disclosure may be used. Among other elements, device 100 includes a multipurpose button 105 as an input component, a touch screen display 110 as both an input and output component, and a speaker 115 as an output component, all of which are housed within a device housing 120. Device 100 also includes a primary receptacle connector 125 and an audio plug receptacle 130 within device housing 120. Each of the receptacle connectors 125 and 130 can be positioned within housing 120 such that the opening to the cavity of the receptacle connectors into which a corresponding plug connector is inserted is located at an exterior surface of the device housing 120. In some embodiments, the cavity opens to an exterior side surface of device 100.

For simplicity, various internal components, such as the control circuitry, graphics circuitry, bus, memory, storage device and other components of electronic media device 100 are not shown in FIG. 1. Embodiments of the disclosure disclosed herein are suitable for use with plug connectors that are configured to mate with primary receptacle connector 125 to transmit and receive data signals and/or audio signals. Additionally, in some embodiments, electronic media device 100 has only a single receptacle connector 125 that is used to physically interface and connect the device (as opposed to a wireless connection which can also be used) to other electronic devices or accessories.

Figure 2:
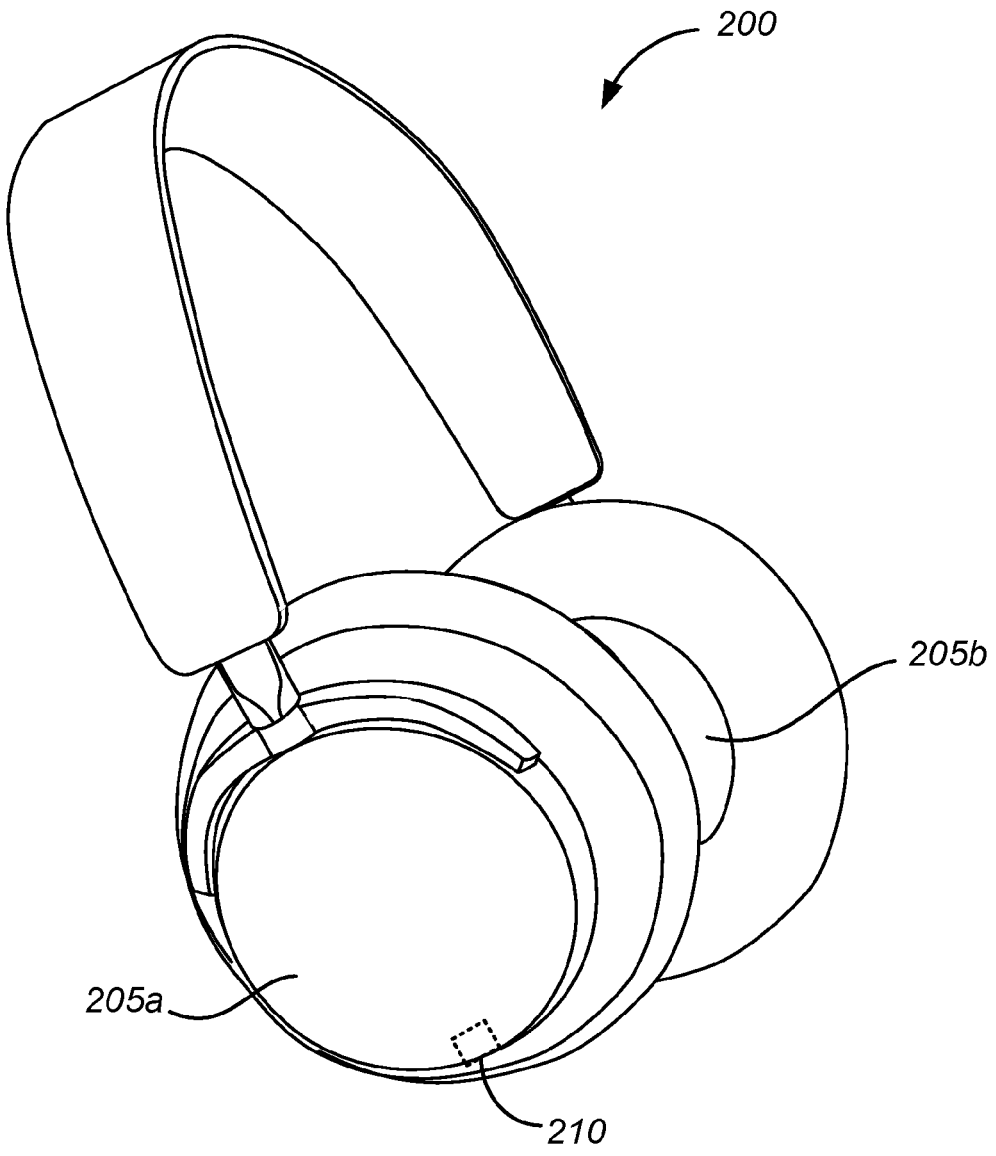
FIG. 2 shows a perspective view of headphones in accordance with some embodiments of the disclosure.

Reference is now made to FIG. 2, which is a perspective view of headphones 200 with which embodiments of the disclosure may be used. Headphones 200 are one example of an accessory that can be used in conjunction with electronic media device 100 of FIG. 1, for example. Headphones 200 include ear pads 205*a* and 205*b*. Ear pads 205*a* and 205*b* each house a speaker (not shown) as an output component. Headphones 200 also include a receptacle connector 210. The receptacle connector 210 is configured to receive a corresponding plug connector that may provide audio signals to headphones 200. In some embodiments, receptacle connector 210 can have the same pinout as primary receptacle connector 125 of FIG. 1 but may have a different depth than receptacle connector 125. For example, the distance between the contacts within receptacle connector 210 and the connector opening at the exterior of device 200 may be less than the distance between the contacts within receptacle connector 125 and the connector opening at the exterior of device 100 as described in more detail below.

For simplicity, various internal components, such as the control circuitry and other components are not shown in FIG. 2. Embodiments of the disclosure disclosed herein are suitable for use with plug connectors that are configured to mate with receptacle connector 210 to transmit and receive audio signals. Receptacle connector 210 may be used to physically interface and connect the accessory (as opposed to a wireless connection which can also be used) to host devices providing audio signals to headphones 200 and/or to provide electrical power to headphones 200 to operate the headphones or charge an internal battery (not shown). Although shown and described as headphones 200, it is contemplated that any accessory may include an integrated receptacle connector 210 that may be used to physically interface and connect the accessory to a host device. For example, in other audio-based accessory embodiments, an accessory may include speakers, sound bars, and the like. In some embodiments, a wired audio-only receptacle connector 210 for audio-based accessories (e.g., headphones 200) may be useful for situations in which wireless transmissions are undesirable or prohibited, such as on an airplane.

Figure 3:
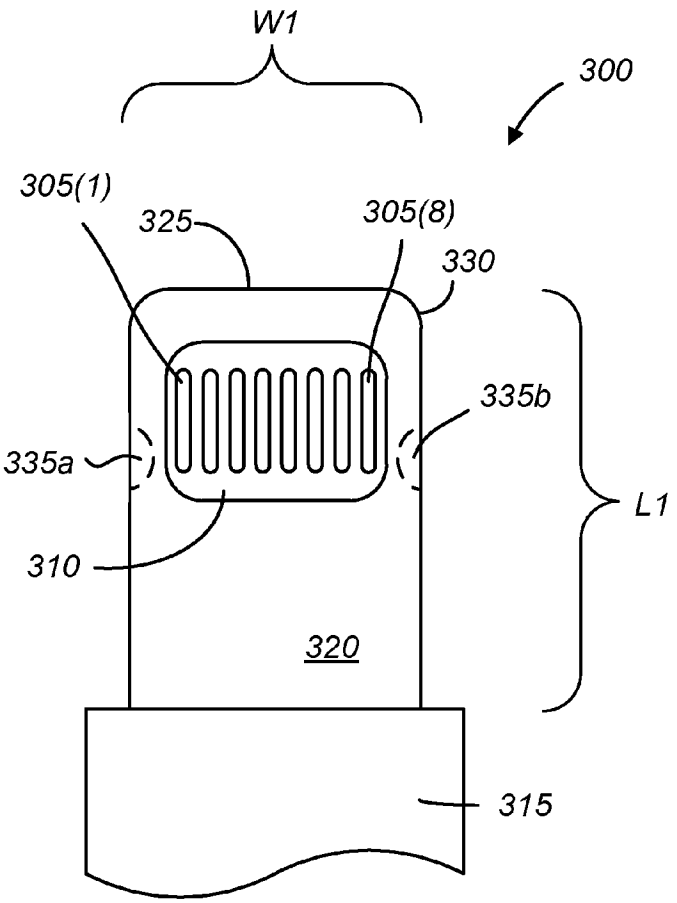
FIG. 3 shows a top view of a plug connector that may be received in a host device in accordance with some embodiments of the disclosure.

Reference is now made to FIG. 3, which depicts a top view of a plug connector 300 that may be received in a host device, such as device 100 of FIG. 1. As shown, plug connector 300 may have eight electrical contact pins 305(1)-305(8) spaced apart in a single row in contact region 310 according to an embodiment of the disclosure. Similarly, eight electrical contact pins may be correspondingly spaced apart in a single row in a contact region on the bottom of the plug connector 300 (not shown). As used herein, the electrical contact pins may be referred to interchangeably as "contacts". In some embodiments, however, one or more electrical contacts may be added or omitted on either side of plug connector 300 as discussed below with respect to FIG. 10. As shown in FIG. 3, plug connector 300 includes a body 315 and an insertion end 320 that extends longitudinally away from body 315 in a direction parallel to the length of the plug connector 300. A cable may be attached to body 315 at an end opposite of insertion end 320, as described further herein.

Insertion end 320 is sized to be inserted into a corresponding receptacle connector of a host device during a mating event. When insertion end 320 is inserted into a corresponding receptacle connector, body 315 abuts a housing of the receptacle connector or host device that the receptacle connector is incorporated in. In some embodiments, insertion end 320 is between 5-10 mm wide (W1), between 1-3 mm thick and has a length (L1) or an insertion depth (the distance from the connector tip 325 of the insertion end 320 to the body 315) of between 5-15 mm. Also in some embodiments, insertion end 320 has a length L1 that is greater than its width W1 which is greater than its thickness. In other embodiments, the length L1 and width W1 of insertion end 320 are within 1.0 mm of each other. In one particular embodiment, insertion end 320 is between 6-7 mm wide (W1), 1-2 mm thick and has an insertion depth (L1) of between 6-8 mm.

Insertion end 320 may further be sized and shaped to be inserted into a receptacle connector of an accessory device during a mating event. In embodiments in which the receptacle connector of the accessory device has an insertion cavity that is shallower than the insertion cavity of that of a host device, body 315 and a portion of the insertion end 320 may protrude from the housing of the receptacle connector or accessory device that the receptacle connector is incorporated in. Nevertheless, the electrical contact pins 305(1)-305(8) of the insertion end 320 may make electrical contact with and be electrically compatible with the shallower insertion cavity of the accessory device, as described further herein.

In some embodiments the structure and shape of insertion end 320 is defined by a ground ring 330 that can be made from stainless steel or another hard conductive material. In some embodiments ground ring 330 can include a flange portion or spine 350 (shown in FIG. 7B). Plug connector 300 can include retention mechanisms 335*a*, 335*b* formed as curved pockets in the side of ground ring 330 that, in some embodiments, do not extend to the upper surface or lower surface of tab 320. Within body 315 is a printed circuit board (PCB) that extends into ground ring 330 between contact region 310 and a corresponding contact region on the bottom of tab 320 (not shown) towards the distal tip of connector 300. One or more integrated circuits (ICs), such as Application Specific Integrated Circuit (ASIC) chips can be operatively coupled to the PCB to provide information regarding connector 300 and any accessory or device that plug connector 300 is part of and/or to perform specific functions, such as authentication, identification, contact configuration and current or power regulation.

As an example, in one embodiment, an ID module is embodied within an IC operatively coupled to the contacts of plug connector 300. The ID module can be programmed with identification and configuration information about the connector and/or its associated accessory that can be communicated to a host device during a mating event. As another example, an authentication module programmed to perform an authentication routine, for example a public key encryption routine, with circuitry on the host device can be embodied within an IC operatively coupled to the plug connector 300. The ID module and authentication module can be embodied within the same IC or within different ICs. As still another example, in embodiments where plug connector 300 is part of a charging accessory, a current regulator can be embodied within one of the ICs. The current regulator can be operatively coupled to contacts that are ab le to deliver power to charge a battery in the host device and regulate current delivered over those contacts to ensure a constant current regardless of input voltage and even when the input voltage varies in a transitory manner.

As shown in FIG. 3, eight external contacts 305(1)-305(8) are spaced apart along a single row in contact region 310. In some embodiments connector 300 is reversible and each contact in contact region 310 is electrically connected to a corresponding contact in a contact region on the opposite side of the connector 300 (not shown) that can be identical in size, shape and contact spacing to contact region 310. Contacts 305(1)-305(8) can be used to carry a wide variety of signals including digital signals and analog signals as well as power and ground as previously discussed. In some embodiments, contacts 305(1)-305(8) includes at least one electrical contact pin configured to transmit audio signals and at least one electrical contact pin configured to transmit data. For example, contact 305(1) may correspond to ground; contacts 305(2) and 305(3) may correspond to a first pair of data contacts (e.g., D+ and D− contacts); contact 305(4) may correspond to an accessory identification contact; contact 305(5) may correspond to main power; contacts 305(6) and 305(7) may correspond to a second pair of data contacts; and contact 305(8) may correspond to accessory power. Some or all of these contacts may remain unused. In some embodiments, contacts 305(1)-305(8) are dimensioned and spaced apart in accordance with the pinout of a lightning connector developed by Apple Inc.

In one embodiment, and as shown in FIG. 3, each contact 305(1)-305(8) has an elongated upper contact surface. In some embodiments, the overall width of each contact is less than 1.0 mm at the surface, and in some embodiments, the width is between 0.75 mm and 0.25 mm. In some embodiments, a length of each contact 305(1)-305(8) is at least 3 times as long at the surface than its width, and in other embodiments, a length of each contact 305(1)-305(8) is at least 5 times as long at the surface than its width. Although shown and described as having eight contacts 305(1)-305(8), it is contemplated that any number of contacts may be included in contact region 310 and embodiments of the disclosure are not limited to any particular contact configuration. In other words, one or more of contacts 305(1)-305(8) may be omitted, or one or more additional contacts may be added or the contacts may be spaced apart differently than what is shown in FIG. 3. In addition, the contacts may conform to the same pinout standard as shown in FIG. 3 but one or more of contacts 305(1)-305(8) may be omitted as discussed below with respect to FIG. 10.

Figure 4:
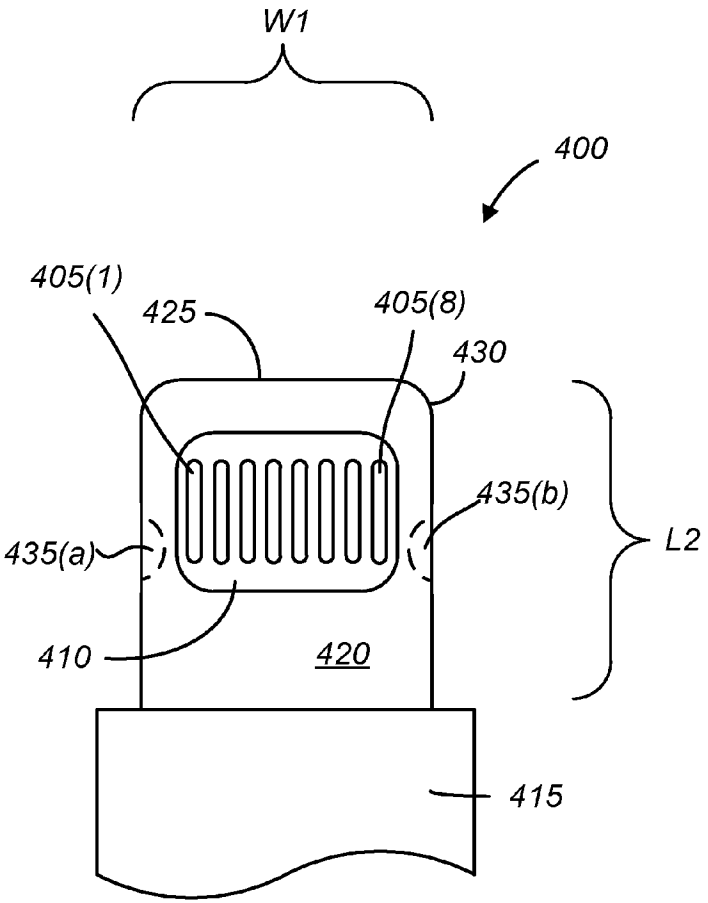
FIG. 4 shows a top view of a plug connector that may be received in an accessory in accordance with some embodiments of the disclosure.
Figure 5A:
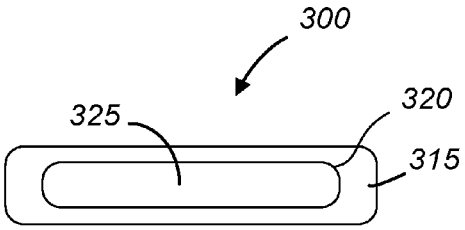
FIG. 5A is a simplified front view of the plug connector shown in FIG. 3 in accordance with some embodiments of the disclosure.
Figure 5B:
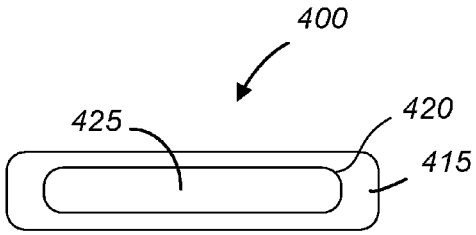
FIG. 5B is a simplified front view of the plug connector shown in FIG. 4 in accordance with some embodiments of the disclosure.

Reference is now made to FIG. 4, which depicts a top view of a plug connector 400 that may be incorporated within an accessory, such as headphones 200 of FIG. 2. Plug connector 400 can be similar or identical to plug connector 300 in many aspects as evident by a comparison between the two figures. Additionally, and for convenience, elements in FIG. 4 that are similar to elements in FIG. 3 use the same tens and ones digits and only differ in the hundreds digit. Thus, as an example, the contacts and retention features of connector 400 (referenced as contacts 405(1)-405(8) and retention features 435*a*, 435*b*, respectively) can be similar or identical to the contacts and retention features of connector 300 400 (referenced as contacts 305(1)-305(8) and retention features 335*a*, 335*b*, respectively). Additionally, insertion end 420 of connector 400 can have the same width (W1) and thickness as the insertion end 320 of connector 300 such that the cross-sectional views of the two insertion ends look similar or identical as shown in FIGS. 5A and 5B, which are front plan views of connectors 300 and 400, respectively. Having essentially the same insertion end cross-section enables connector 300 and 400 to be inserted into the same receptacle connector.

One manner in which connector 400 differs from connector 300, however, is in the length of the insertion end of each connector. As evident by a comparison between FIGS. 3 and 4, insertion end 420 is shorter than insertion end 320 (i.e., L2 is less than L1). As discussed in detail below, the shortened connector 400 cannot be operatively coupled to receptacle connectors (e.g., receptacle connector 125) that have an insertion cavity sized to accept a connector having a longer insertion end, such as connector 300. Instead, a mechanical stop (e.g., body 415) on the shortened plug connector prevents insertion end 420 from being inserted into the cavity of the standard length receptacle connector at a depth at which the contacts of connector 400 reach and come into physical contact with the receptacle connector contacts. The converse is not true, however, as both the longer connector 300 and the shorter connector 400 can be operatively coupled to receptacle connectors (e.g., receptacle connector 210) that have an insertion cavity sized to accept a connector having the shorter insertion end, such as connector 400.

Figure 6:
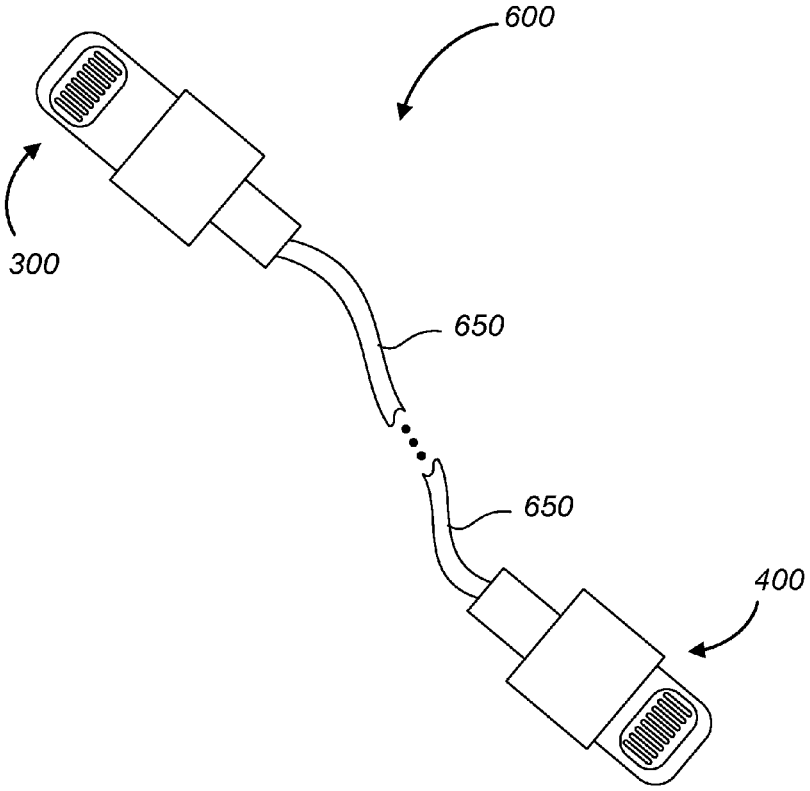
FIG. 6 depicts a top view of a connector assembly in accordance with some embodiments of the disclosure.

Reference is now made to FIG. 6, which depicts a top view of a male-to-male cable connector 600 (i.e., an electrical connector that can connector two devices having appropriate receptacle connectors together such that the devices can exchange data or other signals) according to some embodiments of the disclosure. Cable connector 600 includes first and second male plug connectors 300 and 400 at opposite ends of a cable 650 where the insertion plug of connector 400 is shortened in length as compared to the insertion plug of connector 300. For example, plug connector 300 has a length sufficient to mate with a receptacle connector of a host device (e.g., connector 125 in host device 100 of FIG. 1) while plug connector 400 has a length that enables connector 400 to mate with a receptacle connector of an accessory (e.g., connector 210 of headphones 200 of FIG. 2) but not with a receptacle connector of a host device (e.g., connector 125 in host device 100).

Cable 650 may be of any suitable length for transmitting signals between plug connector 300 and plug connector 400. Cable 650 may include multiple insulated wires interconnecting corresponding contacts of plug connector 300 to contacts of plug connector 400. For example, contact 1 of plug connector 300 may be operatively connected to contact 1 of plug connector 400, contact 2 of plug connector 300 may be operatively connected to contact 2 of plug connector 400, contact 3 of plug connector 300 may be operatively connected to contact 3 of plug connector 400, etc. Cable 650 may further include one or more ground wires soldered to ground rings of plug connector 300 and plug connector 400 to provide a ground signal.

In some embodiments, cable connector 600 may be unidirectional since there is only one way in which the cable connector can be operatively coupled between a host device 100 and an accessory device 200. Specifically, the different lengths of connectors 300 and 400 allow cable connector 600 to be operatively coupled to transfer data (e.g., audio data) and/or power between a host device having a standard depth receptacle connector and an accessory device having a shortened receptacle connector as long as the cable connector is connected such that shortened depth plug connector 400 is mated with the shortened receptacle connector of the accessory device and the standard length plug connector 300 is mated with the standard depth receptacle connector 400. Cable connector 600 cannot, however, be used to electrically connect two devices that each have standard depth receptacle connectors (e.g., two host devices having receptacle connectors 125) as the shortened plug connector 400 cannot be operatively connected to the standard depth receptacle connector of either such device.

Since the physical layout of the pinout of standard length plug connector 300 and shortened plug connector 400 can be substantially the same or even identical, some users may erroneously believe that it is possible to transfer data, power, or other useful signals between two host devices (e.g., between two iPhones) by connecting one of the plug connectors 300, 400 to a first host device and connecting the other of the plug connectors to a second host device. The host devices, however, may not be designed to allow for such. By using different lengths for plug connector 300 and plug connector 400, cable connector 600 is not capable of electrically connecting two host devices together. That is, the shortened connector 400 cannot be operatively coupled to receptacle connectors that have an insertion cavity sized to accept a connector having a longer insertion end, such as connector 300. Instead, the body 315 of connector 400 contacts and abuts the housing of the device in which the receptacle connector is included preventing the contacts of connector 400 from mating with the contacts of the receptacle connector.

Furthermore, in some embodiments, receptacle connectors 125, 210 on the host and accessory devices can include retention mechanisms that latch with retention mechanisms on a plug connector. In such embodiments, the length of the shortened plug connector 400 of cable connector 600 can be sufficiently short that the retention mechanism of plug connector 400 does not engage with the retention mechanism of the standard host receptacle connector during a mating event and thus provides a user no mechanical feedback of a mating event and will simply fall out of the receptacle if moved. The standard length plug connector 300, on the other hand, can be operatively connected to, and provide mechanical feedback via its retention mechanism, when mated with, either the shortened receptacle connector 210 or the standard receptacle connector 125.

Figure 7A:
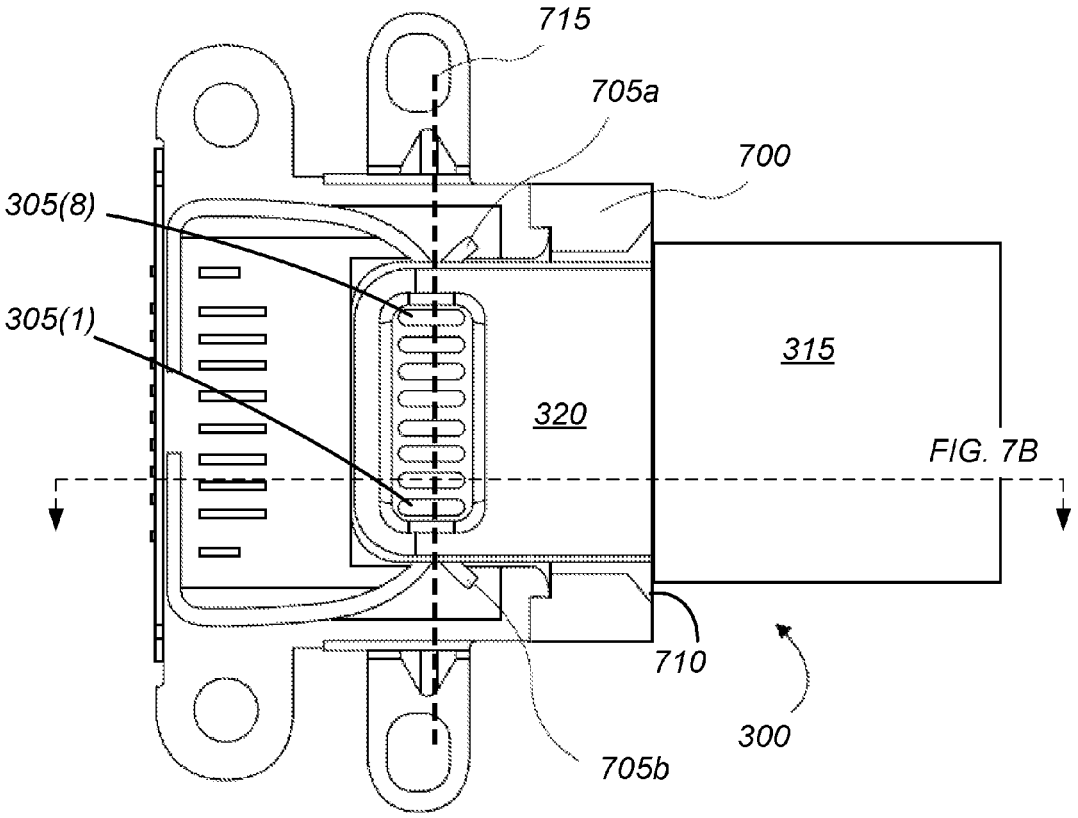
FIG. 7A depicts a top view of a plug connector mated to a receptacle connector of a host device in accordance with some embodiments of the disclosure.
Figure 7B:
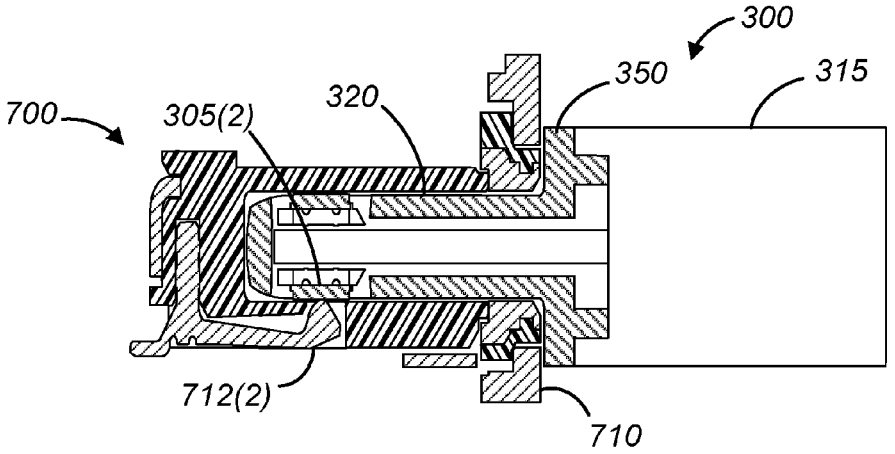
FIG. 7B depicts a simplified cross-sectional view of the plug and receptacle connectors shown in FIG. 7A.

The unidirectional nature of cable connector 600 is further described below with respect to FIGS. 7-9. As part of the description, reference is first made to FIG. 7A, which is a simplified illustration of plug connector 300 from cable connector 600 operatively coupled to a receptacle connector 700 of a host device according to some embodiments of the disclosure, and FIG. 7B, which is a simplified cross-sectional view of connectors 300 and 700 shown in FIG. 7A. Receptacle connector 700 can be representative of, for example, connector 125 of host device 100. In FIGS. 7A and 7B, plug connector 300 is fully inserted into the receptacle connector 700 of the host device. The receptacle connector 700 has interior dimensions defining an insertion cavity that are similar to the exterior dimensions of insertion end 320 of plug connector 300. Thus, insertion end 320 is fully surrounded by the interior dimensions of the receptacle connector 700 of the host device.

As shown in FIG. 7A, when insertion end 320 of plug connector 300 is fully inserted in receptacle connector 700 of the host device, retention mechanisms (not visible in FIG. 7A) of plug connector 300 are engaged by retention latches 705*a*, 705*b* to hold insertion end 320 in place within receptacle connector 700, and the electrical contacts of insertion end 320 are fully aligned with the electrical contacts of receptacle connector 700. In other words, the electrical contacts of insertion end 320 and the corresponding electrical contacts of receptacle connector 700 (e.g., contact 712(2) shown in FIG. 7B) are all centered about axis 715, establishing electrical contact between corresponding contacts of plug connector 300 and contacts of receptacle connector 700 of the host device. Thus, the insertion end 320 of plug connector 300 are properly mated with and mechanically and electrically compatible with the receptacle connector 700. Additionally, when insertion end 320 is fully inserted into the receptacle connector 700, body 315 abuts a housing 710 of the receptacle connector.

Figure 8A:
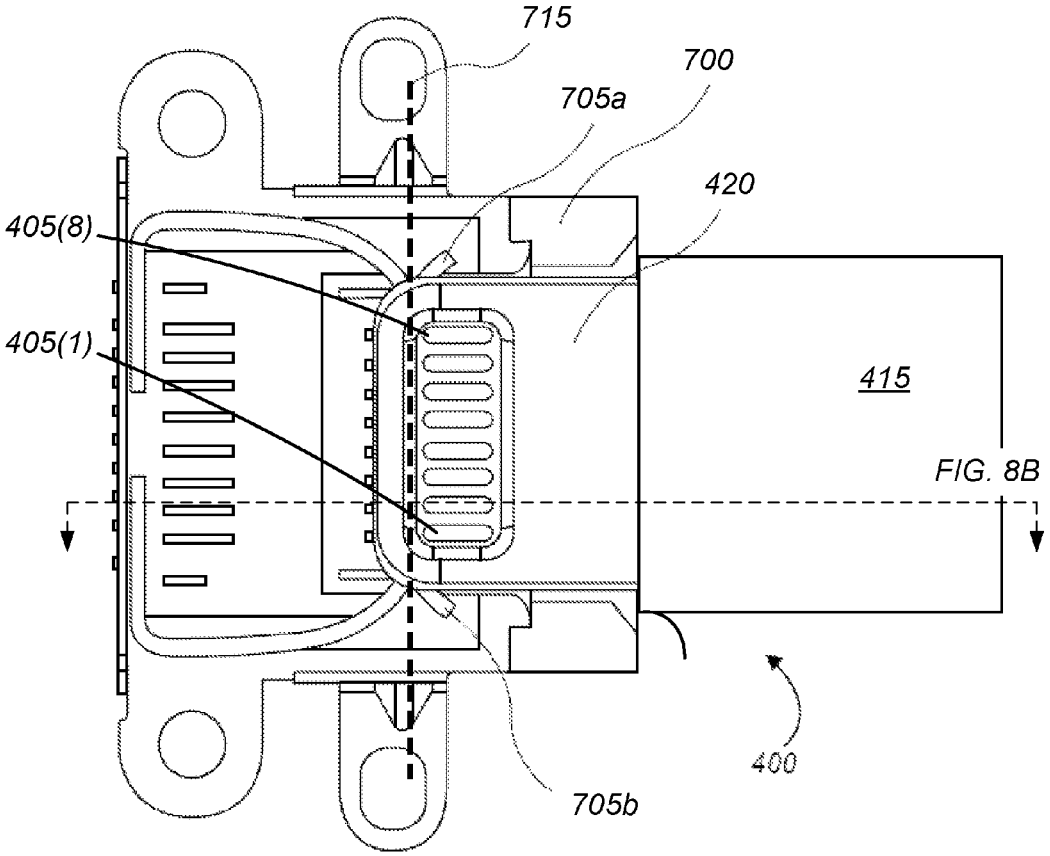
FIG. 8A depicts a top view of a plug connector that is not mechanically compatible with a receptacle connector of a host device in accordance with some embodiments of the disclosure.
Figure 8B:
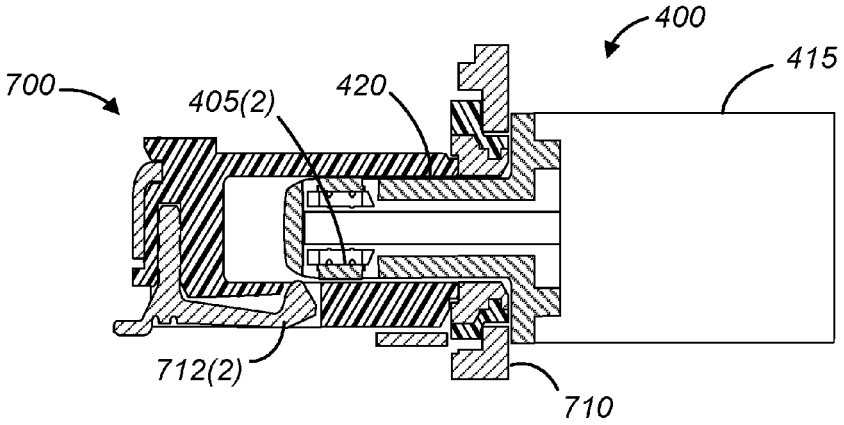
FIG. 8B depicts a simplified cross-sectional view of the plug and receptacle connectors shown in FIG. 8A.

The shortened plug connector 400 cannot be operatively coupled to receptacle connector 700, however. Instead, the shortened insertion end 420 prevents connector 400 from being fully inserted into a host device that includes a standard depth receptacle connector, such as connector 700. For example, reference is now made to FIG. 8A, which depicts a top view of a shortened plug connector 400 that has been inserted into a standard depth receptacle connector 700 of a host device according to some embodiments of the disclosure, and FIG. 8B, which is a simplified cross-sectional view of connectors 400 and 700 shown in FIG. 8A. As described above, plug connector 400 is intended to be mated to an accessory having a shallower receptacle connector. Thus, when plug connector 400 is inserted into the receptacle connector 700 of the host device the greater interior length dimension of connector 700 prevents connector 400 from being operatively coupled to connector 700. Instead, as shown in FIGS. 8A and 8B, body 415 (although in other embodiments other types of mechanical stops can be employed instead) abuts a housing 710 of the receptacle connector limiting the depth at which connector 400 can be inserted within receptacle connector 700. And, at its fully inserted depth, electrical contacts 405(1)-405(8) of connector 400 are not aligned with the corresponding electrical contacts of receptacle connector 700. For example, as shown in FIG. 8B, contact 405(2) of connector 400 is not in physical or electrical contact with contact 712(2) of connector 700. Thus, electrical signals cannot be passed between the contacts of plug connector 400 and the contacts of receptacle connector 700. The shorter length of plug connector 400 also prevents the retention mechanisms (not shown in FIG. 8A or 8B) of plug connector 400 from engaging with retention latches 705*a*, 705*b* preventing connector 400 from being held in place within receptacle connector 700. Thus, as shown in FIGS. 8A and 8B, plug connector 400 is not mechanically compatible with the receptacle connector 700.

Figure 9A:
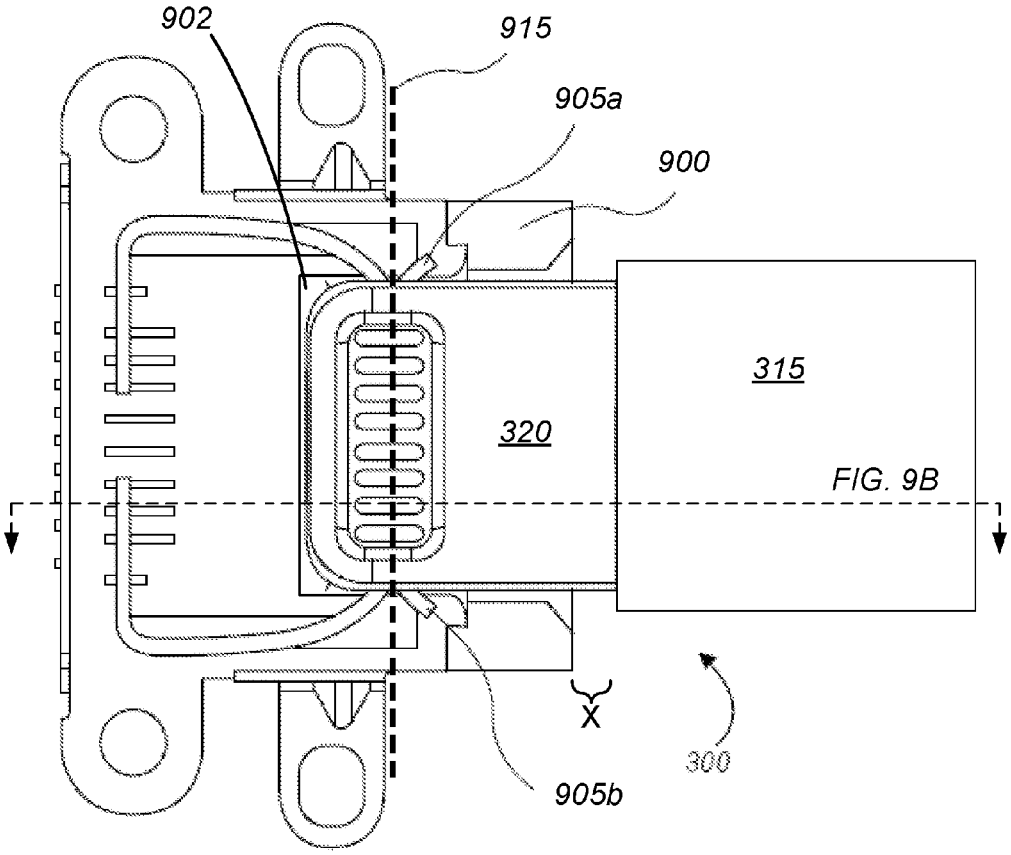
FIG. 9A depicts a top view of a plug connector mated with a receptacle connector of an accessory device in accordance with some embodiments of the disclosure.
Figure 9B:
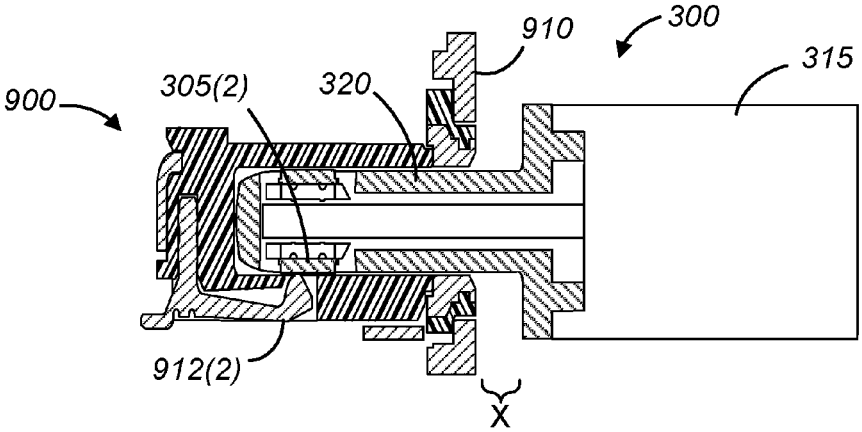
FIG. 9B depicts a simplified cross-sectional view of the plug and receptacle connectors shown in FIG. 9A.

As discussed above, some accessory devices can include a receptacle connector that has a shallower cavity in which to receive the plug connector than connector 700. An example of such a connector is shown in FIGS. 9A and 9B where FIG. 9A depicts a top view of a standard length plug connector 300 mated to a receptacle connector 900 of an accessory according to some embodiments of the disclosure and FIG. 9B is a simplified cross-sectional view of connectors 400 and 700 shown in FIG. 8A. Receptacle connector 900 may be a shallow receptacle connector (i.e., a receptacle connector configured for mating with the plug connector 400) that can be mated with (and is mechanically and electrically compatible with) both plug connector 300 and plug connector 400.

As shown in FIGS. 9A and 9B, plug connector 300 has been fully inserted into and operatively coupled with receptacle connector 900. The receptacle connector 900 has interior dimensions defining an insertion cavity 902 that are similar to the exterior dimensions of insertion end 420 of plug connector 400, but that is then shallower than the length of insertion end 320 of plug connector 300. Thus, when plug connector 300 is mated with receptacle connector 900, the insertion end 320 protrudes from the receptacle connector 900 as shown in FIGS. 9A, 9B such that body 315 is spaced apart from housing 910 of the receptacle connector, which can be at an exterior surface of the accessory that connector 900 is formed within, by a distance X.

When the two connectors are mated, the electrical contacts of connector 300 are fully aligned with the electrical contacts of receptacle connector 900. In other words, the electrical contacts 305(1)-305(8) carried by insertion end 320 and the corresponding electrical contacts of receptacle connector 900 all have contact surfaces aligned along axis 915 enabling physical and electrical contact between corresponding contacts of plug connector 300 and contacts of receptacle connector 900 of the accessory. For example, as shown in FIG. 9B, contact 305(2) of connector 300 is in electrical contact with contact 912(2) of connector 900. Thus, connector 300 is mechanically and electrically compatible with receptacle connector 900.

While not shown in the figures, when plug connector 400 is mated with receptacle connector 900, body 415 of connector abuts housing 910 of the receptacle connector in a manner similar to that shown in FIG. 7B where body 315 abuts a housing 710 of receptacle connector 700. Additionally, when plug connector 400 and receptacle connector 900 are mated, contacts 405(1)-405(8) align with corresponding contacts of receptacle connector 900 just as contacts 305(1)-305(8) align with corresponding contacts of receptacle connector 700, and the retention mechanisms of plug connector 300 are engaged by retention latches 905*a*, 905*b* of receptacle connector 900 to hold connector 400 in place within the receptacle connector.

In some instances, the connection of a standard length plug connector 300 to a shortened receptacle connector 900 may be improper. In such an example, it would be evident to a user inserting the plug connector 300 into the shallow receptacle connector that the two connectors have different physical characteristics. For example, if plug connector 300 is 1 mm in length longer than the insertion cavity of the receptacle connector 900, then plug connector 300 would protrude from the insertion cavity by 1 mm, and the body of the plug connector 300 would not abut the housing of the shallow receptacle connector. Although the contacts may make electrical contact, mating plug connector 300 with receptacle connector 900 may cause an error. For example, an error may occur if a user attempts to use plug connector 300 to transfer data from a host device to receptacle connector 900, which may not support data transfer.

Figure 10:
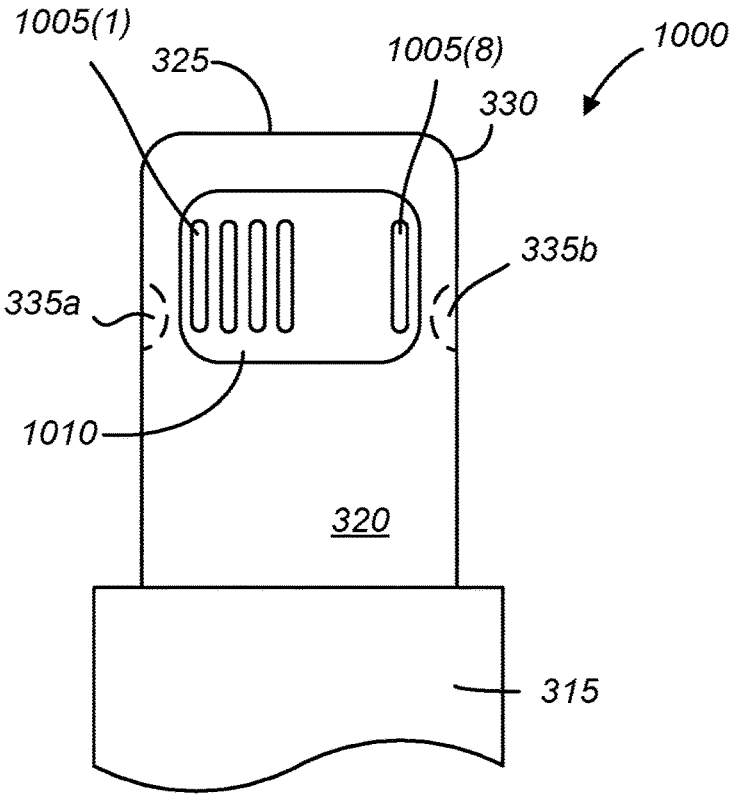
FIG. 10 shows a top view of a plug connector that may be received in a host device in accordance with some embodiments of the disclosure.

As mentioned above, in some embodiments a plug connector can be operatively coupled to (i.e., is mechanically and electrically compatible with) a receptacle connector even though the two connectors have a different number of contacts. As one example, FIG. 10 depicts a plug connector 1000 that has five contacts 1005(1), 1005(2), 1005(3), 1005(4) and 1005(8) that are spaced apart along a single row in contact region 1010. In some embodiments connector 1000 is reversible and each contact in contact region 1010 is electrically connected to a corresponding contact in a contact region on the opposite side of the connector 1000 (not shown). Contacts 1005(1)-1005(8) can conform to the same pinout requirements (e.g., contact spacing, size and signal type) as contacts 305(1)-305(8) discussed above with respect to FIG. 3 or contacts 405(1)-405(8) discussed above with respect to FIG. 4 with the primary difference between connector 1000 and the other connectors being that connector 1000 does not include contacts at contact positions 5, 6 or 7. For example, the device that connector 1000 is part of may not need to those pins for operation. In other embodiments, contacts at different positions can be excluded from the pinout in contact region 1010. Thus, plug connector 1000 can be operatively coupled to either receptacle connector 700 or receptacle connector 900 the same as plug connector 300.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not taught to be exhaustive or to limit the embodiments to the precise forms disclosed. For example, it is contemplated that a USB connector may additionally or alternatively be implemented in conjunction with any or all of the above connectors or connector assemblies. In addition, it is contemplated that the audio-only connectors described herein may alternatively be data-only or power-only connectors. Further, also shown and described with respect to a certain type of plug connector (e.g., an Apple® lightning connector), it is contemplated that embodiments of the disclosure may be implemented with respect to any type of plug connector. As another example, it is contemplated that the "host device" and "accessory device" described herein may be swapped, may pertain to other devices, may pertain to the same device, and/or may pertain to different devices. It will be apparent to one of ordinary skill in the art that many modifications and variations are possible in view of the above teachings.

Also, while a number of specific embodiments are disclosed with specific features, a person of skill in the art may recognize instances where the features of one embodiments can be combined with the features of another embodiment. For example, some specific embodiments of the disclosure set forth above are illustrated with pockets as retention features. A person of skill in the art may appreciate that any other retention features may be used instead of or in addition to the pockets. Also, those skilled in the art may recognize, or be able to ascertain, many equivalents to the specific embodiments of the disclosure described herein. Such equivalents are intended to be encompassed by the following claims.

What is claimed is:

1. A cable connector comprising:

a cable having a first end and a second end;

a first plug connector at the first end of the cable, the first plug connector including a first body, a first insertion end extending away from the first body to a first connector tip and a first plurality of contacts, the first insertion end and the first plurality of contacts sized and positioned to be mated with and mechanically and electrically compatible with a first receptacle connector; and a second plug connector at the second end of the cable, the second plug connector including a second body, a second insertion end extending away from the second body to a second connector tip and a second plurality of contacts, the second insertion end and second plurality of contacts configured to be mated with and mechanically and electrically compatible with the first receptacle connector, wherein the first insertion end has a first length from the first connector tip to the first body and the second insertion end has a second length from the second connector tip to the second body, the second length being shorter than the first length such that the first insertion end and first plurality of contacts are configured to be mated with and mechanically and electrically compatible with a second receptacle connector having an insertion cavity that is deeper than an insertion cavity of the first receptacle connector while the second insertion end and second plurality of contacts are mechanically incompatible with the second receptacle connector.

2. The cable connector of claim 1 wherein the first plurality of contacts are exposed at an external surface of the first plug connector and the second plurality of contacts are exposed at an external surface of the second plug connector.

3. The cable connector of claim 2 wherein each of the first and second pluralities of contacts are spaced apart along a single row.

4. The cable connector of claim 1 wherein each of the first and second plug connectors are reversible connectors that can be inserted in the first receptacle connector in either a first orientation or a second orientation rotated 180 degrees from the first orientation.

5. The cable connector of claim 1 wherein the first plug connector has a uniform thickness along the width and length of the first insertion end and wherein the second plug connector has a uniform thickness along the width and length of the second insertion end connector.

6. The cable connector of claim 5 wherein a thickness of the first insertion end is the same as a thickness of the second insertion end.

7. The cable connector of claim 1 wherein each of the first and second plug connectors includes a retention mechanism configured to mate with a retention latch in a receptacle connector.

8. The cable connector of claim 1 wherein a first distance is defined between the first connector tip and the first plurality of contacts, a second distance is defined between the second connector tip and the second plurality of contacts, and wherein the first distance and the second distance are equal.

9. The cable connector of claim 8 wherein a third distance is defined between the first connector tip and the first body, a fourth distance is defined between the second connector tip and the second body, and wherein the third distance is greater than the fourth distance.

10. The cable connector of claim 9 wherein the first plurality of contacts includes the same number of contacts as the second plurality of contacts.

11. A cable connector comprising:

a cable having a first end and a second end;

a first plug connector at the first end of the cable, the first plug connector including a first body, a first insertion end extending away from the first body to a first connector tip, and a first plurality of contact; and a second plug connector at the second end of the cable, the second plug connector including a second body, a second insertion end extending away from the second body to a second connector tip, a second plurality of contacts, wherein the second insertion end and the second plurality of contacts are sized and positioned to be mated with and mechanically and electrically compatible with the first receptacle connector;

wherein the first plug connector can be operatively coupled with a first receptacle connector having a first plurality of receptacle connector contacts positioned within a first cavity at a first distance from an opening of the first cavity and the second plug connector can be operatively coupled with the first receptacle connector; and wherein the first plug connector can be operatively coupled with a second receptacle connector having a second plurality of receptacle connector contacts positioned within a second cavity at a second distance from an opening of the second cavity, the second distance being less than the first distance, and the second plug connector cannot be operatively coupled with the second receptacle connector.

12. The cable connector of claim 11 wherein each of the first and second plug connectors are reversible connectors that can be inserted in the first receptacle connector in either a first orientation or a second orientation rotated 180 degrees from the first orientation.

13. The cable connector of claim 12 wherein the first plurality of contacts includes a first set of contacts exposed at a first external surface of the first plug connector and a second set of contacts exposed at a second external surface of the first plug connector opposite the first external surface and wherein the second plurality of contacts includes a third set of contacts exposed at a first external surface of the second plug connector and a fourth set of contacts exposed at a second external surface of the second plug connector opposite the first external surface.

14. The cable connector of claim 13 wherein a pinout of each of the first, second, third, and fourth sets of contacts is identical.

15. The cable connector of claim 14 wherein the first plug connector includes a first retention mechanism and the second plug connector includes a second retention mechanism; wherein a first distance is defined between the first tip and the first retention mechanism, a second distance is defined between the first retention mechanism and the first body, a third distance is defined between the second tip and the second retention mechanism, and a fourth distance is defined between the second retention mechanism and the second body; and wherein the first distance is equal to the third distance and the second distance is greater than the fourth distance.

16. The cable connector of claim 11 wherein the cable comprises a plurality of insulated wires that connect at least some of the first plurality of contacts with at least some of the second plurality of contacts.

17. A cable connector comprising:

a cable including a first end and a second end;

a first plug connector at the first end of the cable, wherein the first plug connector includes a first tip and a first retention mechanism configured to mate with a first receptacle connector, wherein a first distance is defined between the first tip and the first retention mechanism, and wherein a second distance is defined between the first retention mechanism and the cable; and a second plug connector at the second end of the cable, wherein the second plug connector includes a second tip and a second retention mechanism configured to mate with a second receptacle connector, wherein a third distance is defined between the second tip and the second retention mechanism, and wherein a fourth distance is defined between the second retention mechanism and the cable, wherein the first distance is equal to the third distance and the second distance is greater than the fourth distance.

18. The cable connector of claim 17 wherein the first plug connector includes a first plurality of contacts and the second plug connector includes a second plurality of contacts, wherein each of the first and second pluralities of contacts conforms to the same pinout.

19. The cable connector of claim 17 wherein each of the first and second plug connectors are reversible connectors that can be inserted in the first receptacle connector in either a first orientation or a second orientation rotated 180 degrees from the first orientation.

20. The cable connector of claim 19 wherein the first plurality of contacts are exposed at an external surface of the first plug connector and the second plurality of contacts are exposed at an external surface of the second plug connector.

* * * * *